United States Patent [19]

Shaw

[11] 4,086,072

[45] Apr. 25, 1978

[54] AIR SOURCE HEAT PUMP WITH MULTIPLE SLIDE ROTARY SCREW COMPRESSOR/EXPANDER

[75] Inventor: David N. Shaw, Unionville, Conn.

[73] Assignee: Dunham-Bush, Inc., West Hartford, Conn.

[21] Appl. No.: 782,675

[22] Filed: Mar. 30, 1977

Related U.S. Application Data

[63] Continuation-in-part of Ser. No. 653,568, Jan. 29, 1976.

[51] Int. Cl.[2] ..... F25B 27/00; G05D 23/00

[52] U.S. Cl. ..... 62/2; 62/160; 62/510; 237/2 B

[58] Field of Search ..... 62/510, 175, 238, 505, 62/2, 160; 237/2 B

[56] References Cited

U.S. PATENT DOCUMENTS

| | | | |
|---|---|---|---|
| 2,780,415 | 2/1957 | Gay | 237/2 B |
| 3,795,117 | 3/1974 | Moody et al. | 62/505 |
| 3,913,346 | 10/1975 | Moody et al. | 62/505 |
| 3,931,718 | 1/1976 | Haselden | 62/505 |
| 3,936,239 | 2/1976 | Shaw | 418/201 |
| 4,018,581 | 4/1977 | Ruff et al. | 62/238 |

*Primary Examiner*—William E. Wayner
*Attorney, Agent, or Firm*—Sughrue, Rothwell, Mion, Zinn and Macpeak

[57] ABSTRACT

An air source heat pump system includes in a primary refrigeration circuit a hermetic screw compressor and a helical screw rotary expander selectively clutchable to the permanently coupled helical screw compressor and electric induction drive motor. A solar/reclaim evaporator alternately functions as an expander boiler to feed refrigerant vapor to the compressor injection slide valve or to the feed port of the helical rotary screw expander to cause the expander to drive the compressor under compressor load or to drive the electric induction motor as a generator with the compressor unloaded. The solar/reclaim evaporator and expander boiler may be selectively fluid connected to the injection slide valve or to the suction port of the compressor. The hydronic system heating condenser and water chilling evaporator coil may form basic input and rejection heat exchangers to cascaded building zone heat pumps. Additional heat input to the primary circuit may be provided by a fossil fueled combustion heater feeding through the expander of the hydronic system heating condenser.

27 Claims, 5 Drawing Figures

AIR SOURCE HEAT PUMP WITH MULTIPLE SLIDE ROTARY SCREW COMPRESSOR/EXPANDER

This application is a continuation in part application of application Ser. No. 653,568 filed Jan. 29, 1976, entitled "HEAT PUMP HIGH EFFICIENCY REVERSIBLE HELICAL SCREW ROTARY COMPRESSOR" to the same inventor and assigned to the common assignee.

BACKGROUND OF THE INVENTION

1. Field of the Invention

This invention relates to heat pump systems which employ a multiple slide valve helical screw compressor and more particularly to such a system which cascades an air source heat pump through a two-pipe arrangement to a closed loop of circulating liquid such as water, employing individual water to air heat pumps for zone heating of a building to be conditioned.

Applicant's U.S. Pat. No. 3,936,239 and applicant's copending application Ser. No. 653,568 now U.S. Pat. No. 4,058,988 employ a helical screw rotary compressor within a heat pump, heating and cooling refrigeration system wherein the compressor employs multiple, axially shiftable slide valves for; controlling the capacity of the compressor, matching the closed thread pressure of the compressor at discharge to discharge line pressure, controlling the point of injection of a refrigerant gas return from a subcooling or economizer coil, or a high pressure evaporator coil to a point within the compression process which is at a higher pressure than the suction pressure of the compressor and at a lower pressure than the discharge pressure of the compressor, and axially adjusting the point of compressed working fluid vapor removal for feeding a secondary closed refrigeration loop at a pressure less than that of full compressor discharge.

The heat pump heating and cooling system, particularly within the copending application, is provided with an air source evaporator/air cooled condenser coil positioned exterior of the building to be conditioned and which advantageously employs that coil as a source of thermal energy for heating the building, particularly by way of hydronic system heating condenser within the building and within the closed loop including the compressor and the air source evaporator/air cooled condenser coil.

In both that application and the present application, the helical screw rotary compressor incorporates a number of longitudinally shiftable slide valves which preferably consist of a suction or capacity control slide valve, a pressure matching or discharge slide valve, an injection slide valve for injecting vapor into the compressor at a point of the compression process intermediate of the compressor suction and discharge pressures and an ejection port for removing from the compressor partially compressed refrigerant vapor for feeding refrigerant through a secondary loop constituting a lower pressure heat exchanger.

SUMMARY OF THE INVENTION

The present invention is directed to such an air source heat pump system which further incorporates a helical screw rotary expander which is of similar construction to the helical screw rotary compressor except that it expands the refrigerant vapor and acts to drive the compressor or by overspeeding the rotor of the induction motor and thus, delivers to the power network feeding the drive motor electrical energy, particularly at low compressor loading. Preferably, an electric drive motor is mechanically coupled to the compressor to drive the compressor and a clutch interposed between the motor and the expander permits the expander to be selectively mechanically coupled to the fixedly linked electrical drive motor and helical screw rotary compressor. A solar/reclaim evaporator and expander boiler is selectively connected to the injection port of the injection slide valve of the compressor or to the expander inlet port, dependent upon system mode of operation. The primary loop refrigeration system may provide selective chilling and heating derived solely from a solar source, heat reclaim source or the like, without the utilization of the air source evaporator and the load may be effected by feeding refrigerant to the compressor by way of the injection slide valve and capacity slide valve with all slide valves being shifted to meet varying loads and operating conditions.

An auxiliary combustion boiler which is direct flame fired from a fossil fuel or the like may feed refrigerant vapor at high temperature to the expander in parallel with refrigerant vapor from the solar/reclaim evaporator and expander boiler or in lieu thereof and maximum thermal efficiency may be achieved by directing the expander discharge to the hydronic system heating condenser.

DESCRIPTION OF THE PREFERRED EMBODIMENT

Figure 1:
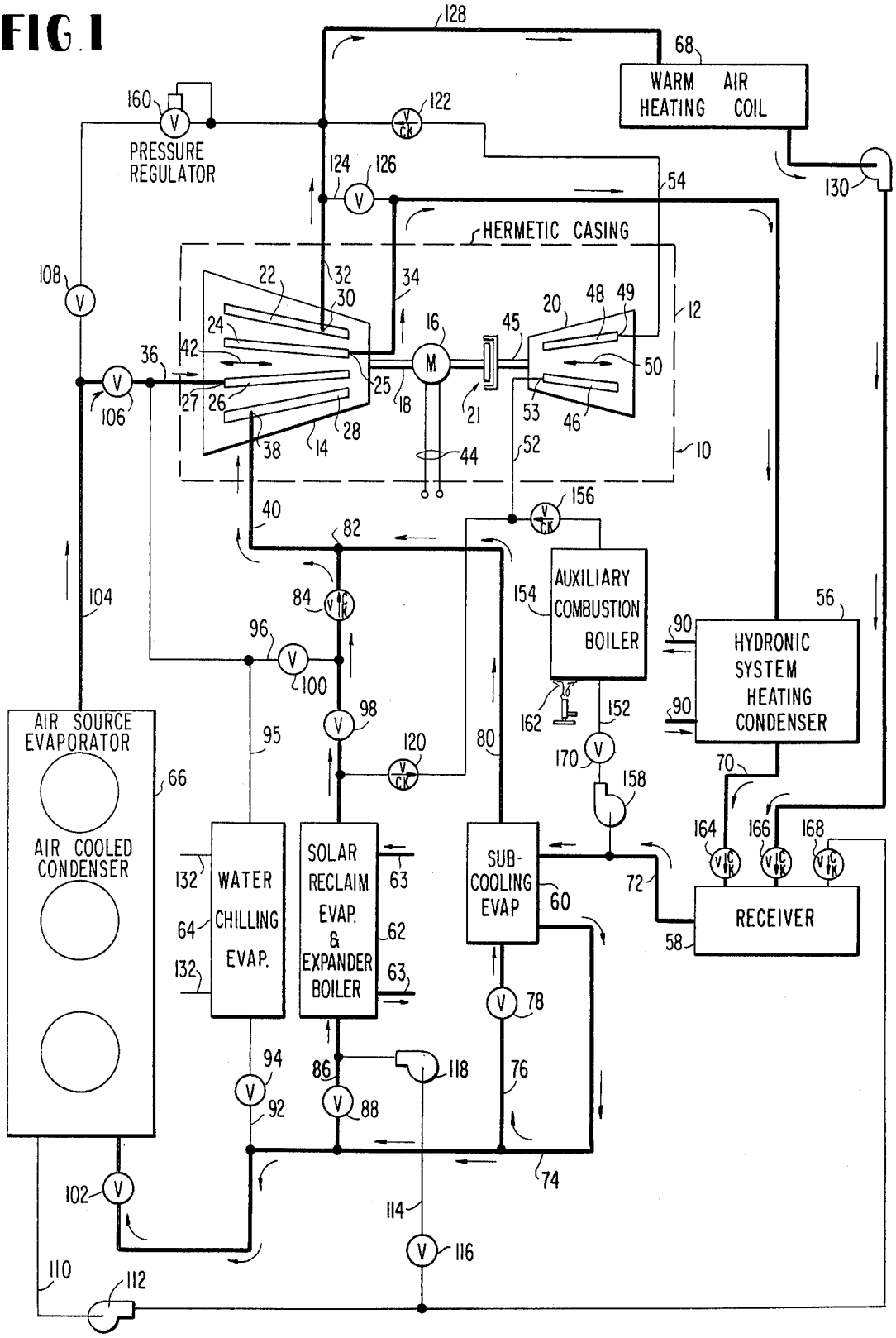
FIG. 1 is a schematic diagram of the improved air source heat pump system of the present invention employing a multiple slide valve rotary screw compressor-/expander under heating mode with the air source and solar/reclaim source operating in parallel.

The present invention comprises an improved, closed loop heat pump system, wherein in the illustrated embodiment of the invention, FIG. 1, a helical screw rotary compressor/expander hermetic package unit indicated generally at 10 comprises a hermetic casing 12 within which is housed a helical screw rotary compressor 14 and an electric drive motor 16 which preferably comprises an electrical synchronous induction motor and being permanently mechanically coupled to the screw compressor 14 by way of shaft 18 for driving the compressor helical screws. Also provided within casing 12 is a helical screw rotary expander 20 and a selectively energizable clutch indicated generally at 21 which functions to selectively, mechanically couple the expander 20 to the permanently mechanically connected drive motor 16 and compressor 14. The helical screw rotary compressor 14 is of the type shown in application Ser. No. 653,568 now U.S. Pat. No. 4,058,988 and comprises four axially or longitudinally adjustable slide valves indicated schematically at 22, 24, 26 and 28. Slide valve 22 constitutes an ejection slide valve and carries an ejection port 30 which permits vaporized working fluid such as refrigerant vapor which is carried within the closed loop refrigeration system to be ejected from the compressor at a pressure intermediate of the suction and discharge pressures of compressor 14. Slide valve 24 constitutes the discharge slide valve and preferably incorporates a pressure sensing means for measuring the pressure of a closed thread adjacent the discharge port and matches that closed thread pressure to the discharge line pressure within compressor discharge line 34 at discharge port 25, to prevent compressor undercompression and overcompression in the identical manner of the referred to copending patent application. The slide valve 26 constitutes the capacity control slide valve for the compressor and effects unloading of the compressor by permitting a portion of the suction gas entering the compressor 14 at suction port 27 from suction line 36, to return to the suction side of the machine without being compressed.

Slide valve 28 carries an injection port 38 which permits vaporized working fluid such as refrigerant vapor to be injected into the compressor at an intermediate pressure point of the compressor process, that is, within a closed thread, which is closed off from the suction line 36 of the machine and discharge line 34.

All of the slide valves 22, 24, 26 and 28 are axially or longitudinally shiftable with respect to the compressor as indicated by double headed arrow 42, this being accomplished and under a control essentially the same as that shown in the referred to copending application.

The helical screw rotary expander 20 is essentially identical to the compressor 14, but in this case the high pressure vapor or working fluid, in expanding between the helical rotary screws of the expander 20, drives the screws relative to each other and thus provides a rotary output to shaft 45 which, through clutch 21, may be coupled to shaft 18 of motor 16 and to compressor 14 to compress another portion of the working fluid passing through the compressor 14. Coextensively, the expander 20 also functions in positively rotating the rotor of the induction motor 16 to generate electrical current which can be delivered from the machine to the electrical supply (not shown) through electrical leads 44.

The expander 20 is provided with a pair of slide valves or members as at 46 and 48, the slide valve 46 and the slide valve 48 being axially shiftable as indicated by double headed arrow 50 so as to vary the point of entry of the working fluid through the expander feed line 52 and slide valve 46 to expander inlet or feed port 53, while slide valve 48 may be shifted to match the pressure within the closed thread of the expander 20 just before discharge to the expander discharge at expander outlet or discharge port 49 line 54 to prevent underexpansion and overexpansion in accordance with the teachings of the applicant's referred to patent and copending application. Again, the means for shifting the slide valves 46 and 48 and their control is essentially the same as that set forth in the referred to copending application and issued patent.

Figure 5:
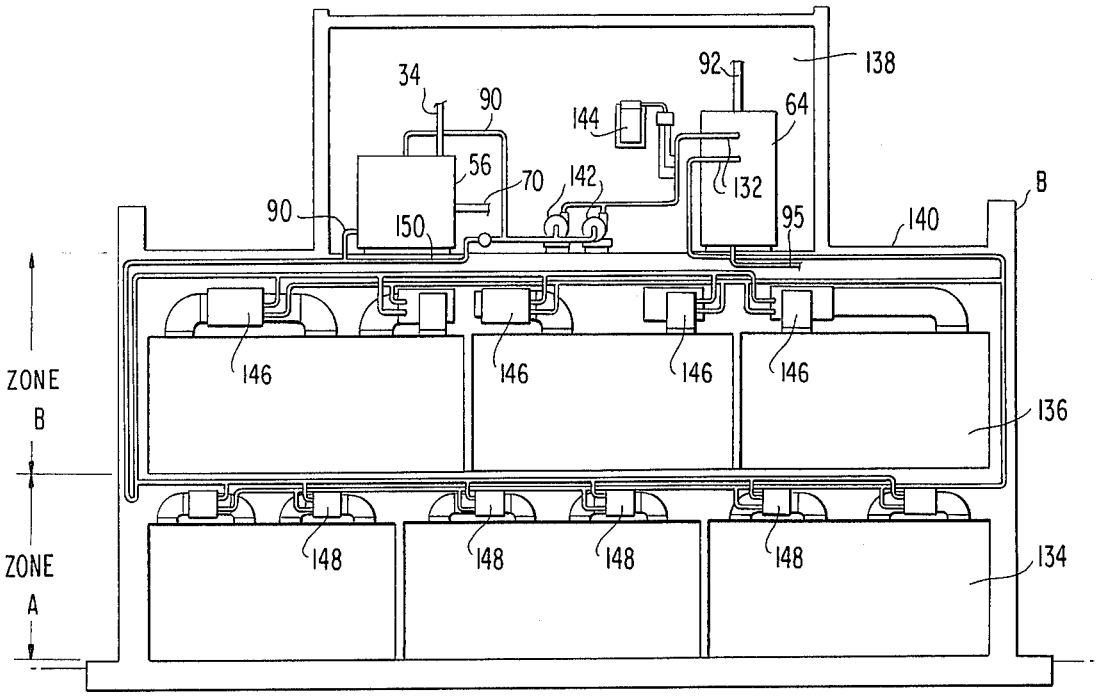
FIG. 5 is an elevational, sectional view of a building structure incorporating a reverse cycle refrigeration system cascaded heat pump with the hydronic system heating condenser and water chiller evaporator of the heat pump system of FIGS. 1–4 constituting the thermal energy input and rejection cascading coils within the reverse cycle building structure refrigeration system.

The hermetic unit 10 comprises one component within the closed loop refrigeration heat pump system which further includes the hydronic system heating condenser or coil 56, receiver 58, subcooling evaporator or coil 60, solar/reclaim evaporator and expander boiler or coil 62, water chilling evaporator or coil 64, air source evaporator/air cooled condenser or coil 66, and warm air heating coil 68, these elements with the exception of receiver 58 constituting heat exchangers for heat exchange between refrigerant working fluid for the primary heat pump system of the illustrated embodiment, the reversible liquid heat pump system for individual zone and room heating of a suitable building or other enclosure as shown in FIG. 5, the atmosphere, etc.

Figure 2:
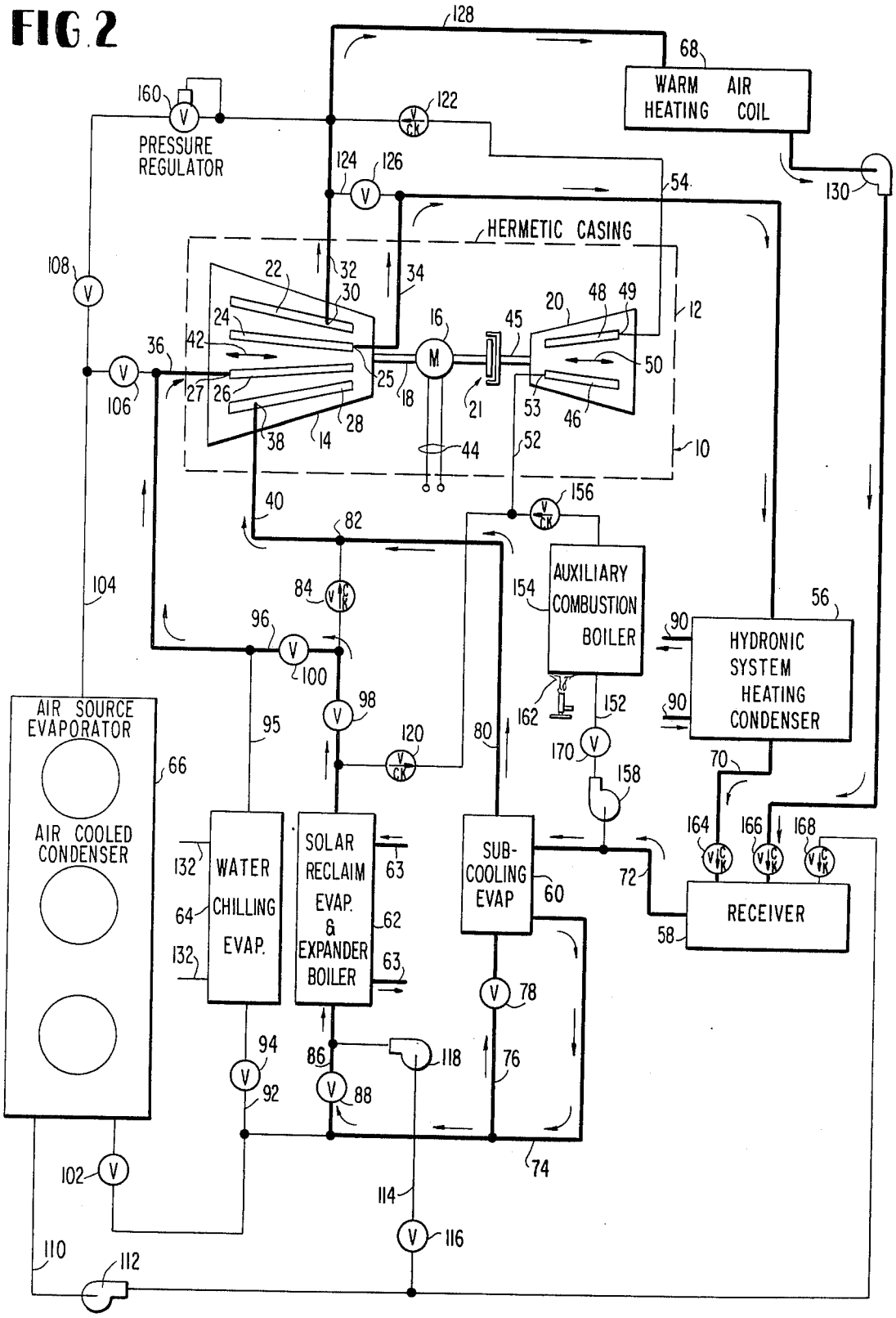
FIG. 2 is a schematic diagram similar to that of FIG. 1, wherein the system is operating under a heating mode with thermal energy input from the solar/reclaim source only.

The receiver 58, the subcooling evaporator 60, the solar/reclaim evaporator and expander boiler 62, the water chilling evaporator 64 and air source evaporator-/air cooled condenser 66, of the embodiment of the invention shown in FIGS. 1–4, are equivalent elements to those shown in FIGS. 1 and 2 of applicant's copending application, although that application is devoid of expander 20, the warm air heating coil and the particular circuit connections and control valves employed in the present invention. In that regard, the compressor discharge line 34 directs the compressor discharge normally to the hydronic system heating condenser 56 which preferably serves as the heat input to the cascaded zone heat pump system of FIG. 5, the refrigerant vapor discharging from the compressor condensing to liquid at high pressure within unit 56 and passing to receiver 58 through line 70. In order to subcool the refrigerant liquid, a line 72 connects the receiver to the subcooling evaporator 60 with a portion of the liquid refrigerant vaporizing within the subcooling evaporator by being bled from a refrigerant supply or manifold line 74 for the solar reclaim evaporator and expander boiler 62, the water chilling evaporator 64, and the air source evaporator/air cooled condenser. Line 76 permits a portion of the high pressure, subcooled liquid refrigerant to be bled from the manifold under control of control valve 78, to expand and by way of the latent heat of vaporization to cause the relatively cool, high pressure refrigerant to have its temperature further reduced, with the vapor created during this process within the unit 60 being returned to the hermetic unit 10 by a subcooling evaporator return line 80. The return line 80 opens to the compressor injection line 40 at a point 82 which is downstream of a check valve 84 to insure that regardless of the operation of the system, the subcooling vaporized refrigerant at an intermediate pressure is injected into the helical screw compressor 14 at a point intermediate of the suction and discharge sides of the machine in accordance with the teachings of the referred to patent and copending application.

The manifold or refrigerant supply line 74 is connected to the solar reclaim evaporator and expander boiler 62 by way of a branch line 86 through a control valve 88, which acts to condense any of the liquid such as glycol within the solar reclaim evaporator and expander boiler loop defined by piping or conduits 63 and to pick up thermal energy from such unit and pass it to the primary refrigerant loop of the air source system in FIGS. 1–4 through the hermetic unit 10. Injection line 40 normally carries the vaporized refrigerant to the injection slide valve injection port 38, in this case in the absence of an alternate fluid connection to the suction port 27 by way of suction line 36. The supply manifold line 74 is further connected to the water chilling evaporator 64 by branch line 92 through a control valve 94, the discharge side of the water chilling evaporator 64 being directly connected to the compressor suction line 36 by water chilling evaporator return line 95.

A bypass line 96 is interposed between injection line 40 and the water chilling evaporator return line 95 at a point between a solenoid operated shut off or control valve 98 within the injection line 40 and check valve 84, and this bypass line 96 further includes a solenoid operated control valve 100 such that with valves 100 and 98 open the refrigerant vapor returns to the lower pressure suction side of the machine, permitting more refrigerant to the drawn through the solar/reclaim evaporator and expander boiler 62 under certain conditions as will be seen later rather than requiring that that refrigerant vapor discharge into the machine at a higher pressure level as determined by the injection port 38 carried by the injection slide valve 28.

The supply manifold 74 terminates at its end remote from the subcooling evaporator 60 at one side of the air source evaporator/air cooled condenser and carries a control valve 102. Thermal expansion valves (not shown) or like expansion devices are required on the inlet sides of the subcooling evaporator 60, the solar reclaim evaporator and expander boiler 62, the water chilling evaporator 64, and the air source evaporator-/air cooled condenser 66. Such thermal expansion valves or their equivalent are provided between control valve 78 and the subcooling evaporator 60, control valve 88 and the solar/reclaim evaporator and expander boiler 62, control valve 94 and the water chiller evaporator 64 and control valve 102 and the air source evaporator/air cooled condenser 66.

Additionally, in the manner of the referred to copending application, when thermal energy is to be discharged into the atmosphere, with coil 66 acting as an air cooled condenser, the compressed refrigerant gas will be condensed and heat released to the atmosphere within coil 66 in a reverse type flow, that is, the refrigerant enters the top of the air source evaporator/air cooled condenser coil and is discharged from the bottom, FIGS. 1–4. In that respect, the system further includes a conduit or line 104 which extends between the hermetic unit 10 and the air source evaporator in parallel with suction line 36. The suction line 36 carries a control valve 106, while line 104 includes a control valve 108 for controlling the flow of refrigerant therethrough, valve 106 being closed when valve 108 is open and vice versa. With valve 106 closed and valve 108 open, and the unit 66 acting to condense refrigerant vapor, liquid refrigerant is discharged from coil 66 via line 110, is driven by way of a pump 112 to the receiver 58 within that line.

Pump 112 forcibly pumps the liquid refrigerant from the unit 66 to the receiver 58. Within line 110, an alternate feed line 114 acts to divert a portion of the liquid refrigerant within line 110 under selective control of a control valve 116 to branch line 86 leading to the solar reclaim evaporator and expander boiler 62, entering line 86 intermediate of control valve 88 and that element. There is a pump 118 within the alternate feed line 114 for pumping liquid refrigerant to the coil 62 for expansion under control of a thermal expansion valve or its equivalent (not shown) for element 62.

On the outlet side of the solar reclaim evaporator and expander boiler 62, upstream of control valve 98 and within line 52 leading to the helical coil rotary expander 20, is a check valve 120 which permits the refrigerant vapor to flow to the expander for expansion by way of the expander feed or supply slide valve 46 and inlet port 53 upon closure of control valve 98. After expansion within the helical screw rotary expander 20 and energy conversion, refrigerant vapor is directed to the compressor ejection line 34 by expander return line 54 which includes a check valve 122 within this line preventing reverse flow of refrigerant vapor back to the expander 20 from the compressor 14. The flow of expander refrigerant from the expander 20 passes by way of line 54 to the ejection line 32 of compressor 14 for controlled movement to; the hydronic system heating condenser 56 through branch line 124 and a control valve 126, the warm air heating coil 68 within line 128, or unit 66 via line 104. A pump 130 is incorporated within line 128 downstream of the warm air heating coil 68 for pumping liquid refrigerant therefrom to the receiver 58. Within line 108 is provided a pressure regulator or hold back valve 160 to maintain a given pressure in line 108 upstream of that regulator valve.

Conduits or lines 90 may form a portion of a four pipe water loop for a building heating system and receive heat from hydronic system heating condenser 56. Conduits 132 permit water circulated through the water chilling evaporator 64 to be chilled, piping 132 may form the remaining two pipes of a four pipe closed water loop of a building conditioning system.

Additionally, the improved heat pump system of the present invention is illustrated in FIGS. 1–4 inclusive and incorporates an auxiliary combustion boiler 154 within a line 152 leading from a point within line 72 connecting the receiver to the subcooling evaporator, such that liquid refrigerant is pumped by way of pump 158 within that line to the expander feed line 52 through check valve 156. Thermal energy is applied to the refrigerant passing through the auxiliary combustion boiler by direct flame impingement as by way of flame 162 provided by a fossil fuel source. The high temperature vaporized refrigerant working fluid in expanding within expander 20 drives the shaft 45 which through clutch 21, in turn drives the rotor of the induction motor 16 and the helical screw of compressor 14. While some of the energy is applied to the system by driving the compressor 14, only a portion of the thermal energy is lost during expansion of the working fluid, and in this regard, the working fluid in discharging through expander discharge line 54 may flow through control valve 126 and bypass line 124 to the compressor discharge line 34 and thence to the hydronic system heating condenser 56, where that thermal energy is directly delivered to the liquid circulating within piping 90 and heating the building to be heated, for instance.

Incidentally, in the event of total power failure, the expander could be overdriven by flame impingement of boiler 154 which would permit the heating/cooling system provided by the loop shown be maintained in full operation and also acts to insure at least a limited supply of electricity by overdriving motor 16 and causing it to act as an induction generator.

Referring to FIG. 5, there is shown in partial sectional elevation a building B of multiple floors including a first story or level 134, a second story or level 136, and an equipment room 138 on the top floor of the building, that is, mounted to the roof 140. Within the equipment room 138, there is provided in addition to a plurality of centrifugal pumps 142 and a control panel 144 for controlling the operation of the reverse-cycle conditioning system which connect through a two-pipe arrangement, a series of zone or room water to air heat pumps indicated at 146 within the second story 136 and constituting zone B, and at 148 within story 134 constituting zone A. The present invention has application to a heat pump recovery system constructed and sold by the corporate assignee of the present invention under the trademark AQUA-MATIC, and wherein heat exchangers in the form of the hydronic system heating condenser 56 and the water cooling evaporator 64 form components of the closed loop water system within building B, FIG. 5, and also constitute system components of the primary closed loop heat pump of FIGS. 1–4. Thus, the AQUA-MATIC system of FIG. 5 is cascaded by the incorporation within the system illustrated in FIGS. 1–4 inclusive.

Supply and return piping connect the multiple water to air heat pumps for building levels 134 and 136, as at 146 and 148, to define a circulating water closed loop whose temperature is maintained between preferably 70° to 90° F by means of the water chilling evaporator 64 forming a cooling tower and the hydronic system heating condenser 56 which replaces a hot water boiler, in the more conventional AQUA-MATIC system. The water to air heat pumps 146, 148 may comprise Dunham-Bush Model AQM-42VLT-BN-C1 units, for example.

As illustrated in FIG. 5, the hydronic system heating condenser receives compressed refrigerant vapor from the hermetic package unit 10, FIG. 1, by being coupled to the discharge line 34, the condensed refrigerant leaving the hydronic system heating condenser 56 through line 70 and passing through the receiver (not shown in FIG. 5). Further, in line with the portion of the invention illustrated in FIGS. 1–4, the Water chilling evaporator 64 receives high pressure liquid refrigerant through supply line 92 which refrigerant liquid vaporizes within the water chilling evaporator to reduce the temperature of the circulating water passing through lines 132 leading to that coil, while the return line 95 returns the refrigerant vapor to the suction or intake side of the compressor 14 within closed loop refrigeration heat pump circuit of FIGS. 1–4.

The individual AQUA-MATIC water to air heat pumps within the zones A and B selectively provide heat in one area while cooling another due to temperature needs of each room or area thereof. When a given unit is on the cooling cycle, it absorbs heat through an air coil from the room being cooled, transfers this heat by refrigeration to a water coil where it is extracted by the circulating water; when heat is desired, the cycle of the individual unit is reversed so that heat is absorbed from the water and rejected into the room.

Specifically with respect to FIG. 5, during the summer when all or most of the units are on the cooling mode, the water loop will absorb the heat transferred from the air to the refrigerant. The water chilling evaporator 64 will reject this excess heat to the outdoors. In this case, the coil 66 is functioning as an air cooled condenser to reject heat to the atmosphere. Alternatively, the excess heat may be stored for use at night if water storage facilities are provided. Preferably, a maximum water temperature of 90° F is maintained.

In winter, when all or most of the units are in the heating mode and the water loop temperature falls below 60° F, it is necessary to provide heat to the circulated water within the closed water circulating loop of FIG. 5 by supplying heat to the heating condenser 56. This is done by delivering the discharge from the compressor directly to the hydronic system heating condenser 56 and, in this case, the coil 66 is functioning as an air source evaporator external of the building B being conditioned.

Advantageously, in moderate weather, in temperate climates or during the time the units serving the sunny side of the building are calling for cooling and the ones on the shady side are often calling for heating, and some of the interior units are not needed at all, heat may be placed into the water loop by some units and is being absorbed by others and there is no need for operation of either the water chilling evaporator 64 or the hydronic system heating condenser 56. Energy is thus conserved.

When the air source heat pump system of FIGS. 1–4 inclusive is employed in conjunction with the AQUA-MATIC system of FIG. 5, the hydronic system heating condenser 56 and the water chilling evaporator 64 are never employed at the same time in tempering the water circulating through the main loop piping 150. However, this is not true in a non-cascaded system where, as in FIGS. 1–4 inclusive, which illustrate specifically one such system, the hydronic system heating condenser 56 may be in fact heating circulating liquid within the loop defined by piping 90, while the liquid being circulated within piping 132 leading to and from the water chilling evaporator 64 which is a different liquid from that associated with unit 56, is being cooled, each feeding a conditioning unit within a different portion of the building, for instance. Operation under this mode may be seen in FIG. 3.

With respect to the operation of the system shown in FIG. 1, through various modes, reference may be had to FIGS. 1–4 in sequence.

Preferably, control valves 78, 88, 94, 98, 100, 102, 106, 108, 116 and 126 are solenoid operated valves suitably controlled from a control panel upon receipt of control signals from thermal sensors appropriately located in thermal transfer relationship with respect to the various components of the primary closed refrigeration loop, FIGS. 1–4. The system will operate in dependence upon energization or de-energization of a particular control valve as well as the controlled positioning of slide valves 22, 24, 26 and 28 of the compressor 14 and slide valves 48, 46 of the expander 20 as well as the controlled clutching and de-clutching of clutch 22 mechanically connecting the expander 20 to the induction motor 16 and compressor 14 which themselves are permanently connected by way of shaft 18.

With reference to FIG. 1, the air source heat pump system operates in a heating season mode of operation with the air source and solar/reclaim source operating in prallel. In that respect, control valves 78, 88, 98, 102, 106 and 126 are open and control valves 94, 100, 108, and 126 are closed. The refrigerant flow is shown by the arrows as well as the glycol solution flow with respect to the solar/reclaim evaporator and expander boiler 62 entering and leaving pipes or conduits 63 from a solar panel, solar heated storage tank, etc. Further, the air source pump provides thermal energy to the hydronic system heating condenser 56 for room heating. The thermal energy is picked up from the air by the air source evaporator unit 66 located externally of building B being conditioned. For instance, if solar panels (not shown) are supplying a very hot glycol solution through pipes 63 to the expander boiler, the liquid refrigerant which enters unit 62 by way of branch line 86 and valve 88 which is open, vaporizes and picks up heat which is delivered to the hermetic screw compressor by way of injection port 38 carried by the injection slide 28, the refrigerant vapor passing through open control valve 98 and check valve 84 both of which are within injection line 40. The major portion of the refrigerant discharging from the compressor at compressor discharge port 25 and through discharge line 34 is directed to the hydronic system heating condenser 56, where that heat is given off to the water circulated within pipes 90 leading to and from that unit. The liquid refrigerant from receiver 58 is always subcooled in all four modes by way of subcooling evaporator 60, since a portion of that liquid refrigerant which enters the manifold line 74 is returned to the subcooling evaporator through line 76 under control of valve 78 which is open, the refrigerant vaporizing to take up a portion of the heat which is transmitted by way of subcooling evaporator return line 80 to the injection line 40 merging with the refrigerant vapor emanating from the solar reclaim evaporator and expander boiler 62 and passing through the injection slide port 38 to the screw compressor for recompression. The pressure of the return vapor through injection line 40 is above that of the suction pressure of the screw compressor but below that of the discharge pressure. Since there is no need for cooling of the water within the closed circulation loop leading to water chilling evaporator 64, the valve 94 is closed, and water chilling evaporator 64 is off the line. A major amount of liquid refrigerant enters the air source evaporator/air cooled condenser 66 since control valve 102 is open from manifold line 74, and is vaporized therein, the unit 66 acting as an air source evaporator for picking up heat, the vapor returning to the suction port 27 of the compressor 14 under control of capacity slide valve 26 with control valve 106 open and the refrigerant passing through the suction line 36. Ejection slide 22 under its control is positioned such that the ejection port 30 picks up and bleeds a portion of the compressed refrigerant which is not fully compressed but compressed to a higher pressure than that entering the compressor injection port 38 and that at the suction port 27 and permitting lower pressure compressed refrigerant vapor to pass to the warm air heating coil 68, permitting a portion of a building to be heated at a lower temperature than that provided by heating condenser 56, and separate from that portion of the system. After condensing within the warm air heating coil 68, the condensed liquid refrigerant is pumped by pump 130 through line 128 to receiver 58 where it combines with the liquid refrigerant emanating from the hydronic system heating condenser 56. If operating under heating or heat input mode with the AQUA-MATIC system, when that heat is required by the AQUA-MATIC water loop comprised of piping 150 and the energy input to the water loop is not available from a solar energy storage tank or the like, the air source heat pump of FIGS. 1-4 is utilized and operates basically between an ambient temperature of 25° F down through −20° F, thus delivering energy to the AQUA-MATIC water loop at a condensing temperature in the vicinity of 50° to 60° F by way of the hydronic system heating condenser 56.

Operating between an average temperature of +5° F ambient and +55° F condensing and with a rotary screw compressor operating with correct porting, a coefficient of performance (COP) of 6 may be realized on an overall annual basis for the heat input mode as shown in FIG. 1. A COP of 2.5 is all that is necessary to make this system economical in comparison with an oil fired burner and a COP of 1 is what would be obtained with a straight electric resistance heater. Therefore, a cascade air source input to the basic AQUA-MATIC water loop provides a most efficient way of adding the necessary heat to the AQUA-MATIC loop when solar input is not available or is not utilized other than by way of the solar/reclaim evaporator and expander boiler 62.

If the water leaving or returning to the hydronic system heating condenser 56 starts to rise above a desired set point, the capacity control slide valve 26 of compressor 14 will close down the gas suction port to the compressor. At the minimum flow level, a reed switch indicator associated with the capacity control valve, or a flow sensor within the air source evaporator suction line 36, switches the system into the mode shown in FIG. 2 where operation involves, as a heat source, only the solar/reclaim evaporator and expander boiler 62.

Referring to FIG. 2, which shows a heating mode which does not require the operation of the air source evaporator as a source of thermal energy for the hydronic system heating condenser, the solar/reclaim source may be employed as the thermal energy input to the primary refrigeration loop. Again, the arrows illustrate that portion of the circuit under operation. In this mode, control valves 78, 88, 98 and 100 are open while control valves 94, 102, 106, 108, 116 and 126 are closed. As in FIG. 1, the opening of valve 98 directs refrigerant flow to the expander 20 and normally restricts flow of refrigerant from the solar/reclaim evaporator and expander boiler 64 to the screw compressor 14. The control system, therefore, due to the lack of need of intense heat input to the hydronic system locks out the water chilling evaporator 64 and the air source evaporator/air cooled condenser 66, sufficient heat being provided by the solar/reclaim evaporator and expander boiler 62. Condensed refrigerant passes from receiver 58 to the subcooling evaporator where a portion is returned as vaporized refrigerant through subcooling evaporator return line 80 and injection line 40 to the injection slide port 38 entering the compressor at an intermediate pressure relative to compressor suction and discharge. The major portion of the circulated refrigerant, however, passes through the solar/reclaim evaporator and expander boiler 62 picking up heat from the glycol solution circulated through piping 63 with control valve 88 being open. Control valve 100 is open, permitting this vaporized refrigerant to enter the suction or inlet port 27 of compressor 14, which is at a lower pressure than that of the injection port 38 carried by the injection slide 28. This low pressure permits a relatively large quantity of heat to be extracted from the solar source or reclaim source by way of the solar/reclaim evaporator and expander boiler 62. The check valve 84 within the injection line 40 prevents the higher pressure refrigerant vapor emanating from subcooling evaporator 60 to bypass the injection slide port 38 and seek the suction or inlet port 27 of the compressor 14 through line 95.

A portion of the refrigerant vapor which is partially compressed leaves the compressor through the ejection slide port 30 and ejection line 32 passing through line 128 to the warm air heating coil 68 for heating a portion of building B. However, the major portion of the refrigerant vapor at compressor discharge pressure passes by way of discharge port 25 and discharge line 34 directly to the hydronic system heating condenser 56.

To summarize, the solar/reclaim evaporator and expander boiler 62 is feeding the main suction of the compressor 14. The hydronic system heating condenser is controlling the flow of refrigerant vapor entering the main capacity control slide or may be controlling the flow of refrigerant vapor emanating from the solar/reclaim evaporator and expander boiler 62. The subcooling evaporator 60 continues to feed the gas injection slide 28. For example, if the liquid refrigerant temperature leaving the subcooling evaporator 60 tends to rise above a set point, the gas injection slide 28 would be pulsed closer towards the suction side of the compressor 14, thus returning the liquid refrigerant temperatures on the outlet side of the subcooling evaporator 60 to a predetermined desired level. The slide automatically, in this case, thus increases subcooling to maintain desired temperature. Under this operation, the capacity control slide off loads the compressor as less and less heat is required in the building. It should be noted that the pressure level at the outlet of the solar/reclaim evaporator and expander boiler 62 will tend to rise due to the fact that less heat is being taken from the collector as the building requirements diminish. This rise will occur until the point is reached when sufficient pressure will be available within line 40 and line 52 which branches therefrom to start driving the hermetic helical screw expander 20. At that point, the expander 20 starts to off load the hermetic drive motor 16 to some degree. This requires with valve 108 open the maintenance of sufficient pressure within the line leading to the unit 68, this being taken care of by the upstream pressure regulator 160 to insure that there is enough pressure within this line to maintain sufficient pressure in the warm air heating coil 68. Since the primary purpose of the gas or refrigerant vapor leaving the ejection slide 22 is to supply the warm air heating coil 68 as the temperature increases as it passes across the warm air heating coil and less heating effect is needed, the gas ejection slide is pushed closer to the low pressure side of the compressor, thus feeding less gas to the warm air heating coil.

Figure 3:
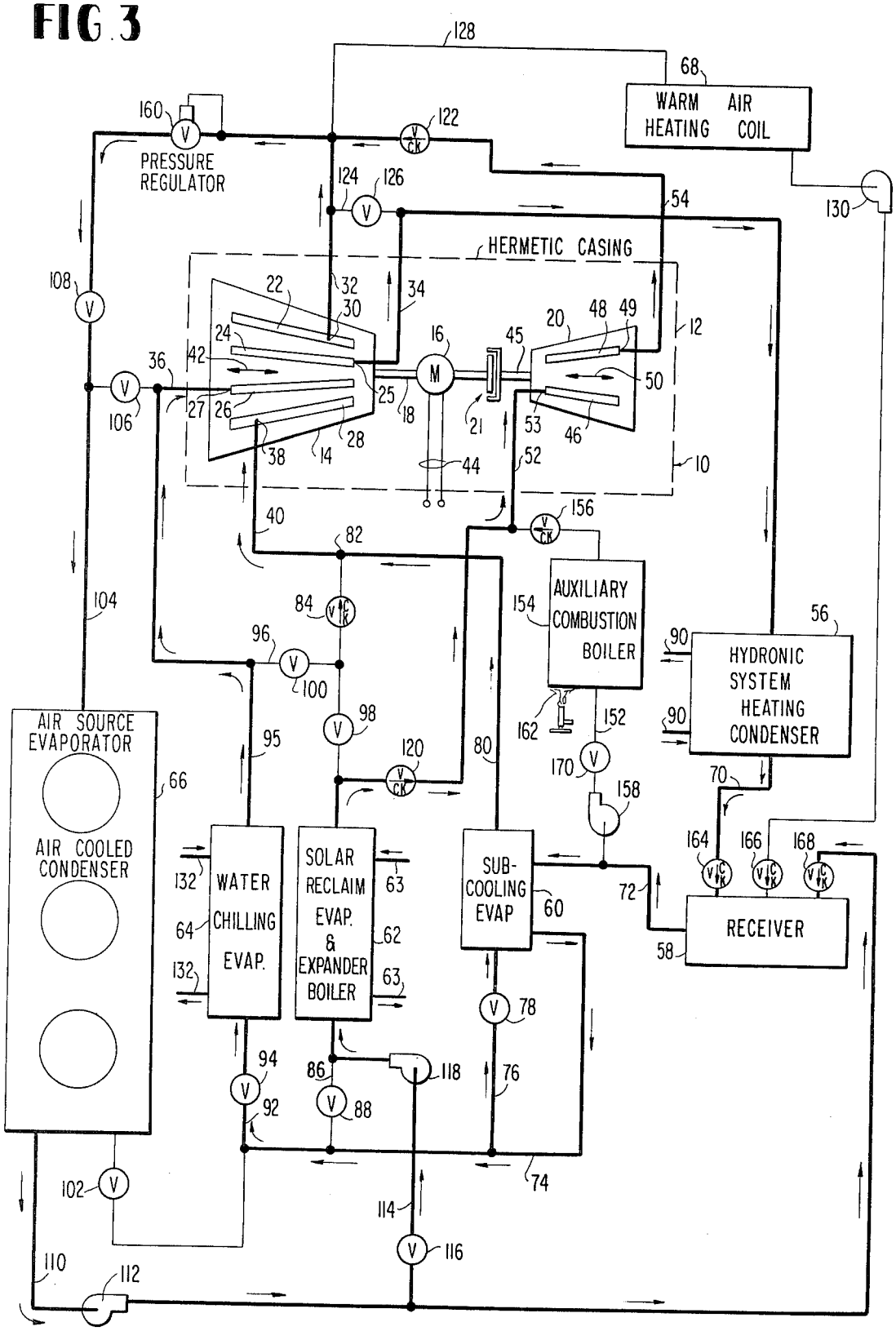
FIG. 3 is a schematic diagram similar to that of FIGS. 1 and 2 under off season heating/cooling mode with the solar source driving the expander/compressor unit.

At this point, we have the condition of FIG. 3, that is, off season heating/cooling. Under the control system permitting operation as shown in FIG. 3, the off season heating/cooling mode occurs when the warm air heating coil no longer need deliver any heated air to a building, the warm air heating coil heating a space temperature up to about 55° F; with the hold back or pressure regulating valve 160 set high enough, there is always sufficient vapor pressure to feed vapor to the warm air heating coil and in such case, the warm air heating coil indeed supplies heat. The capacity control slide valve 26 preferably has its control shifted from leaving hydronic system heating condenser to leaving chilled water temperature for chilling evaporator 64. It should be remembered that the mode of operation in FIG. 3 is not permitted when the system is cascaded with the secondary conditioning loop of FIG. 5, that is, in FIG. 3, simultaneously heat is being supplied to one portion of the building being conditioned by the heating system heating condenser 56, while heat is being absorbed by way of the water chilling evaporator 64 at another portion of the same building. Under such conditions, if the leaving chilled water temperature starts to rise, the slide valve 26 controlling capacity of the compressor shifts to load up the compressor, thus driving more gas out of the water chilling evaporator and tending to reduce the temperature of the circulated water. As to the hydronic system heating condenser 56, if the leaving or entering hydronic system water temperature rises above a desired preset level, the gas ejection slide 22 is pulsed closer to the discharge side of the compressor, thus dumping more and more gas to the outdoor air cooled condenser. Further, the main capacity control slide and suction port which it controls is now being fed from the water chilling evaporator 64--0 and not from the solar/reclaim evaporator and expander boiler 62. Preferably, the capacity control slide valve is controlled off leaving evaporator temperature because the leaving evaporator temperature must be maintained under proper control since primarily cooling is needed. The gas ejection slide shifts to permit an increased amount of refrigerant vapor or gas to be dumped uncompressed to the outdoor air cooled condenser 66, permitting only a slight amount of the gas to be fully compressed and discharged to the hydronic system heating condenser 56, since there are minimal heating needs for the building under such off season conditions. Under the assumption that sufficient thermal energy is available to input to the solar/reclaim evaporator, the expander will begin operation and the expander will discharge into the air cooled condenser 66 through line 104 along with that of ejection slide 22. With a very light cooling/heating mode and with a high solar load, the expander 20 will tend to overspeed the hermetic induction motor 16 and supply power back to the building power grid through lines 44. Conventionally, a hermetic induction motor, when operating at synchronous speed, still requires some magnetizing current from the grid power system. However, with the slightest increase in speed beyond synchronous, the hermetic induction motor starts delivering net power back into the building grid.

In the off season heating/cooling mode, the solar source acts to drive the expander 20 which in turn through clutch 21 drives the compressor 14 constituting a very high efficient mode of operation for the system whether cascaded or not. In that respect, control valves 78, 88, 94, 108 and 116 are open, while control valves 98, 100, 102, 106 and 126 are closed.

As mentioned previously, all of the control valves are energized under an appropriate control system (not shown) as well as clutch 21 to achieve this end. A portion of the partially compressed refrigerant vapor which emanates from the ejection slide port 30 and passing through ejection line 32 as well as a portion of the refrigerant vapor which is discharged after expansion by way of port 49 of the expander 20 and which passes by line 54 through check valve 122, passes to the air source evaporator/air cooled condenser 56 which is acting in a condenser mode. Since control valve 108 is open and control valve 106 is closed, the condensed liquid refrigerant discharges from unit 66 into line 110 where a portion thereof is pumped back to the receiver 58 while another portion is directed to the solar/reclaim evaporator and expander boiler 62 through line 114 and control valve 116 which is open. Pump 118 pumps this liquid from line 110 into the unit 62 where it picks up thermal energy from the solar source, the vaporized refrigerant passing through check valve 120 through line 52 since control valve 98 is closed and entering the feed or inlet port 53 under the control of slide valve 46 of expander 20. Liquid refrigerant from the receiver 58 passes to the subcooler 60 as in the prior modes and is subcooled prior to entering the manifold lines 74, where because of the closure of valve 88 and 102 it is restricted to passage through the water chiller evaporator 64 passing through that unit by way of feed line 92 and suction return line 95.

The major portion of the refrigerant vapor is compressed by compressor 14 and discharges through discharge port 25 under the control of the pressure matching slide 24, which preferably performs a pressure matching function, that is, prevents overcompression and undercompression of the gas within the compressor 14, whereby this refrigerant gas or vapor is directed through discharge line 34 directly to the hydronic system heating condenser 56.

Figure 4:
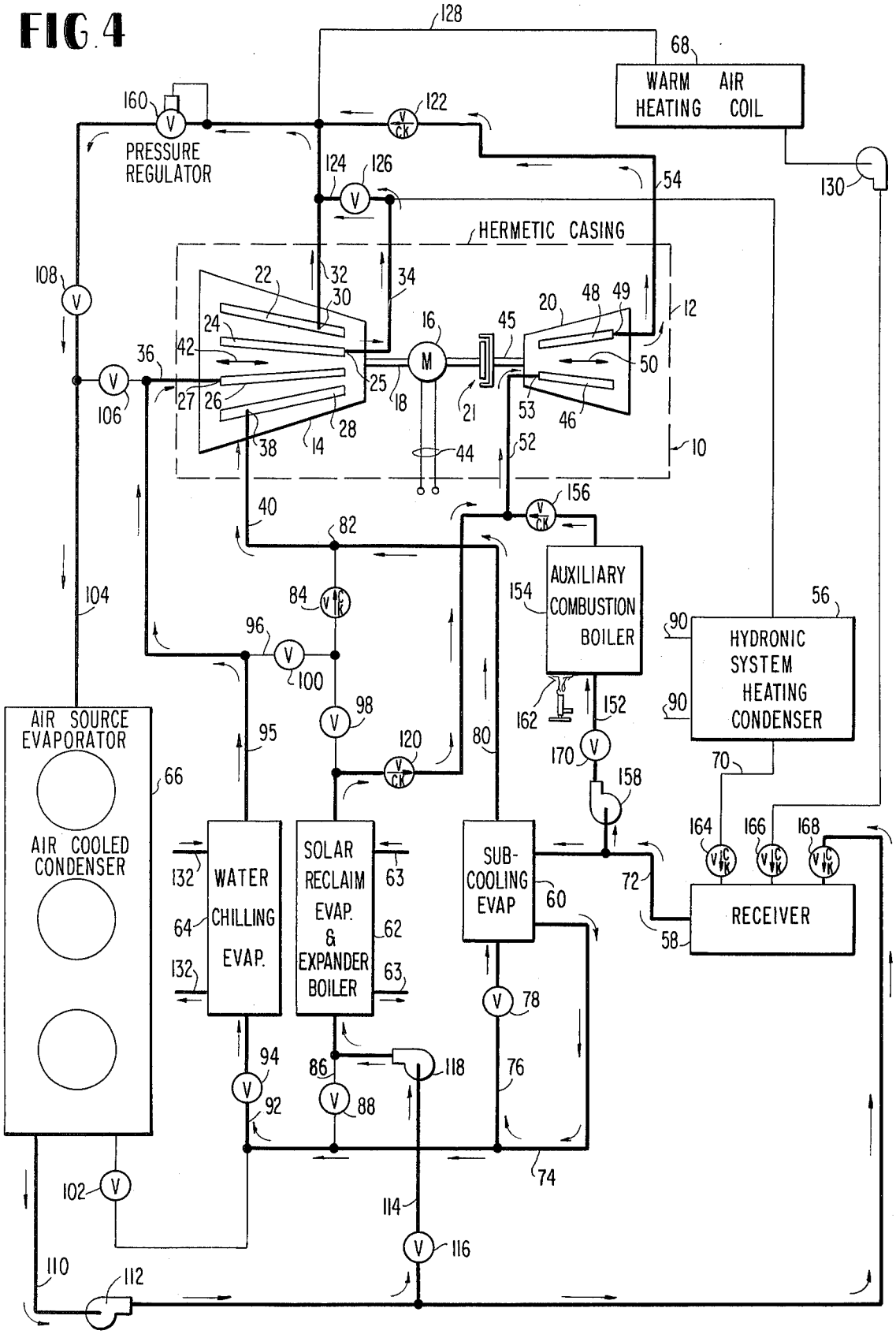
FIG. 4 is a schematic diagram similar to that of FIGS. 1–3 under a cooling mode with the solar source driving the expander/compressor.

Under the full cooling season mode, FIG. 4, there is no longer any need for heat whatsoever within the confines of the building. Therefore, to be sure that no heat is delivered to the building, water flow is stopped through the hydronic system heating condenser 56 and obviously if no water flow occurs, no condensing can occur for the refrigerant vapor within discharge line 34. With valve 126 open in this mode, the gas ejection slide is pulsed all the way over to the discharge side of the machine and sealed off, and all discharge now passes through the main discharge port 25 of the compressor 14. This is also very desirable since under high load cooling, maximum motor cooling is required, and all the gas passes over the hermetic motor on the discharge side of the compressor 14.

In should be remembered that in either a heating or cooling mode, the auxiliary combustion boiler may be employed to impart thermal energy input into the closed refrigeration loop, partially by expanding the vapor which is boiled within the boiler 154 within expander 20 and partially by delivery of the discharge gas from the expander to the hydronic system heating condenser 56.

The total absence of any heating function for building B, FIG. 5, permits both the warm air heating coil 68 and the hydronic system heating condenser 56 from being blocked out of the system, and the essential function of the primary and secondary heat pump systems is to remove heat from the circulated water within piping 150 to the various zone heat pumps 146, 148. Again, the full refrigerant moves in the direction of the arrows. Control valves 78, 94, 108 and 126 are open, control valves 180, 116 and 126 are open and control valves 88, 98, 100, 102 and 106 are closed. The air source evaporator/air cooled condenser 66 functions in its condensing mode, receiving refrigerant vapor from expander 20 and from the ejection slide port 30 of compressor 14 in similar fashion to operation under FIG. 3. The unit is in its full cooling mode with the solar source again driving the expander/compressor which are clutched by way of clutch 21. Both in this mode and that of FIG. 3, the rotor (not shown) of induction motor 116 is physically driven by operation of expander 20 so that it in fact may generate electricity which is fed to its source in a regenerative mode by way of lines 44. The subcooling evaporator 60 feeds the injection slide port 38 at a pressure intermediate of suction and discharge for the screw compressor, valves 100 and 198 are closed and the check valve 84 prevents the refrigerant vapor from passing back to the solar/reclaim evaporator and expander boiler 62 through injection line 40. The coil 66 discharges heat to the atmosphere, while the water chiller evaporator 64 picks up heat from the AQUAMATIC system, FIG. 5. The bypass valve 126 is open within line 124, permitting the compressor discharge gas to pass to the air source evaporator/air cooled condenser 66 acting as a condenser for all the refrigerant vapor to reject heat. With valve 88 closed, thermal energy from the solar source is added to the condensed refrigerant which passes from the air source/evaporator/air cooled condenser 66 via feed line 114 through the open valve 116 under operation of pump 118. Prior to expansion of this refrigerant vapor within expander 20, the refrigerant vapor is prevented from passing to the injection port 38 of injection slide 28 of screw compressor 14 due to closure of control valve 98. The check valve 120 in similar fashion to the mode of FIG. 3 permits the high pressure refrigerant to pass to the expander where it is discharged at the expander outlet port 49 and merges with the refrigerant being discharged from the compressor under partial compression at the ejection port 30, this refrigerant vapor further merging with the refrigerant of compressor discharge port 25, all of this passing through the air source evaporator/air cooled condenser 66.

With reference to FIGS. 1–4 inclusive, the valve 108 for instance may be removed from line 104 due to the presence of the pressure regulator or hold back valve 160. Further, appropriate check valves should be applied leading to the receiver, as indicated at 164 within line 70, 166 within line 128, and 168 within line 110. This insures flow of vapor or liquid refrigerant in a given direction only towards the receiver but prevents reverse flow which would be detrimental to system operation. A control valve 170 is preferably included in line 152 to selectively control refrigerant available to flame 162, which flame is also controlled selectively to add heat to the primary loop via expander 20 as needed or desired.

While the invention has been particularly shown and described with reference to a preferred embodiment thereof, it will be understood by those skilled in the art that various changes in form and details may be made therein without departing from the spirit and scope of the invention.

What is claimed is:

1. In an air source heat pump system including:

a helical screw rotary compressor including a suction port and a discharge port, a helical screw rotary expander including a feed port and a discharge port, means for mechanically connecting said expander to said compressor, a first inside heat exchange coil for conditioning a building and the like, a second outside heat exchange coil connecting an air source evaporator/air cooled condenser, said compressor comprising a plurality of axially adjustable compressor slide valves including at least a capacity control slide valve for unloading the compressor, an injection slide valve including an injection port, and an ejection slide valve including an ejection port, conduit means carrying refrigerant and forming a primary closed loop refrigeration circuit for connecting; at least said screw compressor and said first and second coils in series in that order, the improvement wherein:

said system further includes a third heat exchange coil connected intermediate of said first and second coils with the outlet side of said third heat exchange coil being connected to the injection port of said injection slide valve, and wherein said conduit means further comprises means connecting the outlet side of said third heat exchange coil additionally to the feed port of said expander, and means for connecting the discharge port of said expander to said first heat exchange coil, and selectively operated valve means within said conduit means connecting the outlet of said third heat exchange coil to said injection slide valve injection port for preventing refrigerant return flow from said third heat exchange coil to said compressor and forcing such refrigerant return flow to enter said expander feed port.

2. The air source heat pump system as claimed in claim 1, further comprising a fourth heat exchange coil constituting an auxiliary boiler, and wherein said conduit means includes means intermediate of said first and second heat exchange coils for connecting said fourth heat exchange coil to the feed port of said expander such that regardless of operation of said second or third heat exchange coil, thermal energy is provided by said fourth heat exchange coil to said expander for driving said compressor and for providing direct heat input into said first heat exchange coil for supplying building heat.

3. The air source heat pump system as claimed in claim 2, wherein a synchronous induction motor is fixedly coupled to said screw compressor for driving said screw compressor, and said means for connecting said expander to said screw compressor comprises selectively energizable clutch means such that during operation of said expander and energization of said clutch means, excess mechanical energy from said expander not needed to carry the load of the compressor acts to overdrive the synchronous induction motor and to cause said motor to generate electrical energy.

4. In an air source heat pump system including:

a helical screw rotary compressor including a suction port and a discharge port, a first heat exchange coil constituting a heating condenser, a receiver, a second heat exchange coil constituting a subcooling evaporator, a third heat exchange coil constituting a solar/reclaim evaporator, a fourth heat exchange coil constituting a water chilling evaporator, and a fifth heat exchange coil constituting an air source evaporator/air cooled condenser, and wherein said compressor comprises a plurality of axially adjustable compressor slide valves, the improvement wherein:

said plurality of compressor slide valves comprises at least a capacity control slide valve for unloading said compressor, an injection slide valve carrying an injection port, and an ejection slide valve carrying an ejection port, conduit means carrying refrigerant and forming a primary closed loop refrigeration circuit for connecting; at least said screw compressor, said first coil, said receiver, said second coil and said third coil in series in that order; said second coil, said third coil, said fourth coil and said fifth coil in parallel; the inlets of said second coil, third coil, fourth coil and fifth coil to the outlet of said receiver; the outlet of said second coil to said injection slide valve injection port, the outlet of said third coil selectively to said injection slide valve injection port or said compressor suction port, the outlets of said fourth coil and said fifth coil to said compressor suction port; and selectively operated valve means within said conduit means leading from said receiver to said second, third, fourth and fifth coils to control operation of said heat pump system such that; during a full heating mode, said third and fifth coils operate in parallel to provide thermal energy to said first coil with said fourth coil off the line; in a reduced load heating mode, said third coil only provides thermal energy to said first coil, with said fourth and fifth coils off the line; and during full cooling mode, said fifth coil is reversely connected to said ejection slide valve and to the compressor discharge port with said first coil off the line, with said fifth coil acting as an air cooled condenser to reject heat picked up by said fourth coil.

5. The air source heat pump system as claimed in claim 1, further comprising a sixth heat exchange coil constituting a warm air heating coil, and said conduit means further comprises means for selectively connecting said ejection slide ejection port to the inlet of said warm air heating coil and the outlet of said warm air heating coil to said receiver; such that during reduced heating mode, said third heat exchange coil provides thermal energy through said helical screw compressor to said sixth heat exchange coil.

6. The air source heat pump as claimed in claim 2, wherein said conduit means further comprises a subcooling evaporator line connecting said outlet of said second heat exchange coil to said helical screw compressor injection slide injection port, a solar/reclaim evaporator and expander boiler injection line connecting the outlet of said solar/reclaim evaporator and expander boiler to the injection slide injection port and intersecting said subcooling evaporator return line, a suction line leading from said water chilling evaporator to the suction port of said screw compressor; a bypass line connecting said injection line to said suction line on the outlet sides of said third and fourth heat exchange coils; and wherein a control valve is carried within said bypass line to selectively connect the outlet of said third coil to the compressor suction port; and wherein a check valve is carried within said injection feed line intermediate of said injection slide injection port and the connection of said bypass line to said injection line to prevent refrigerant vapor within the subcooling evaporator return line from feeding to the suction port of the compressor through said bypass line and said suction line.

7. The air source heat pump system as claimed in claim 4, further comprising a helical screw rotary expander, means for selectively mechanically coupling said expander to said compressor for driving said compressor, said expander comprising a feed port and a discharge port, and wherein said conduit means includes means for connecting the outlet of said third heat exchange coil to said expander feed port and means for connecting the expander discharge port to at least the inlet of said first heat exchange coil; whereby, a portion of the thermal energy provided to said closed loop refrigeration circuit by said third heat exchange coil causes by expansion of said refrigerant within said expander driving of said compressor, while a second portion of the thermal energy is delivered directly to said first heat exchange coil and released as useful heat by said heating condenser.

8. The air source heat pump system as claimed in claim 8, wherein said conduit means connecting said outlet of said third heat exchange coil to the feed port of said expander comprises an expander feed line which connects to the injection line downstream of said third heat exchanger and upstream of a control valve for shutting off said third heat exchange coil to said bypass line and to said injection port carried by said helical screw rotary compressor injection slide valve.

9. The air source heat pump system as claimed in claim 2, further comprising a helical screw rotary expander, means for selectively mechanically coupling said expander to said compressor for driving said compressor, said expander comprising a feed port and a discharge port, and wherein said conduit means includes means for connecting the outlet of said third heat exchange coil to said expander feed port and means for connecting the expander discharge port to at least the inlet of said first heat exchange coil; whereby, a portion of the thermal energy provided to said closed loop refrigeration circuit by said third heat exchange coil causes by expansion of said refrigerant within said expander driving of said compressor, while a second portion of the thermal energy is delivered directly to said first heat exchange coil and released as useful heat by said heating condenser.

10. The air source heat pump as claimed in claim 1, wherein said conduit means comprises a subcooling evaporator line connecting said outlet of said second heat exchange coil to said helical screw compressor injection slide injection port, a solar/reclaim evaporator and expander boiler injection line connecting the outlet of said solar/reclaim evaporator and expander boiler to the injection slide injection port and intersecting said subcooling evaporator return line, a suction line leading from said water chilling evaporator to the suction port of said screw compressor; a bypass line connecting said injection line to said suction line on the outlet sides of said third and fourth heat exchange coils; and wherein a control valve is carried within said bypass line to selectively connect the outlet of said third coil to the compressor suction port; and wherein a chech valve is carried within said injection line intermediate of said injection slide injection port and the connection of said bypass line to said injection line to prevent refrigerant vapor within the subcooling evaporator return line from feeding to the suction port of the compressor through said bypass line and said suction line.

11. The air source heat pump system as claimed in claim 3, further comprising a helical screw rotary expander, means for selectively mechanically coupling said expander to said compressor for driving said compressor, said expander comprising a feed port and a discharge port, and wherein said conduit means includes means for connecting the outlet of said third heat exchange coil to said expander feed port and means for connecting the expander discharge port to at least the inlet of said first heat exchange coil; whereby, a portion of the thermal energy provided to said closed loop refrigeration circuit by said third heat exchange coil causes by expansion of said refrigerant within said expander driving of said compressor, while a second portion of the thermal energy is delivered directly to said first heat exchange coil and released as useful heat by said heating condenser.

12. The air source heat pump system as claimed in claim 7, wherein said conduit means connecting said outlet of said third heat exchange coil to the feed port of said expander comprises an expander feed line which connects to the injection line downstream of said third heat exchanger and upstream of a control valve for shutting off said third heat exchange coil to said bypass line and to said injection port carried by said helical screw rotary compressor injection slide valve.

13. The air source heat pump system as claimed in claim 10, wherein said conduit means further comprises a line leading from the discharge port of said helical screw compressor to one side of said fifth heat exchange coil and in parallel with the suction line leading from the same side of said fifth heat exchange coil to the compressor suction port, and said suction line and said parallel line comprise control valves operating alternately such that said fifth heat exchange coil alternates as an air source evaporator or an air cooled condenser dpeending upon system mode.

14. The air source heat pump system as claimed in claim 13, wherein said helical screw rotary expander further comprises an axially shiftable adjustable capacity control slide valve for controlling the amount of refrigerant supplied to said expander at said feed port and an axially adjustable pressure matching slide valve at said expander discharge port for matching the pressure of the expanded refrigerant within the expander just prior to discharge to that at the discharge port and to prevent expander over and under expansion, and wherein said expander return line includes a check valve to prevent refrigerant from passing from said compressor back to said expander through said expander return line.

15. The air source heat pump system as claimed in claim 1, further comprising a helical screw rotary expander, means for selectively mechanically coupling said expander to said compressor for driving said compressor, said expander comprising a feed port and a discharge port, and wherein said conduit means includes means for connecting the outlet of said third heat exchange coil to said expander feed port and an expander return line for connecting the expander discharge port to at least the inlet of said first heat exchange coil; whereby, a portion of the thermal energy provided to said closed loop refrigeration circuit by said third heat exchange coil causes by expansion of said refrigerant within said expander driving of said compressor, while a second portion of the thermal energy is delivered directly to said first heat exchange coil and released as useful heat by said heating condenser.

16. The air source heat pump system as claimed in claim 5, wherein said conduit means connecting said outlet of said third heat exchange coil to the feed port of said expander comprises an expander feed line which connects to the injection line downstream of said third heat exchanger and upstream of a control valve for shutting off said third heat exchange coil to said bypass line and to said injection port carried by said helical screw rotary compressor injection slide valve.

17. The air source heat pump system as claimed in claim 9, wherein said conduit means further comprises a line leading from the discharge port of said helical screw compressor to one side of said fifth heat exchange coil and in parallel with the suction line leading from the same side of said fifth heat exchange coil to the compressor suction port, and said suction line and said parallel line comprise control valves operating alternately such that said fifth heat exchange coil alternates as an air source evaporator or an air cooled condenser depending upon system mode.

18. The air source heat pump system as claimed in claim 12, wherein said helical screw rotary expander further comprises an axially shiftable adjustable capacity control slide valve for controlling the amount of refrigerant supplied to said expander at said feed port and an axially adjustable pressure matching slide valve at said expander discharge port for matching the pressure of the expanded refrigerant within the expander just prior to discharge to that at the discharge port and to prevent expander over and under expansion, and wherein said expander return line includes a check valve to prevent refrigerant from passing from said compressor back to said expander through said expander return line.

19. The air source heat pump system as claimed in claim 12, further comprising a pressure regulator within the line leading from the compressor to the fifth heat exchange coil and parallel to the suction line and being operable relative to the sixth heat exchange coil to insure flow of compressed refrigerant gas to said sixth heat exchange coil during operation under full heating and partial heating mode.

20. The air source heat pump system as claimed in claim 9, further comprising piping means defining a closed water circulation loop, means for alternately, thermally connecting said first and fourth heat exchange coils to said piping means forming said closed water circulation loop, and a plurality of individual, selectively operable cascade zone heat pumps connected in series within said piping means forming said closed water circulation loop; whereby, said cascade heat pumps may selectively add and subtract heat to the water circulating within said piping means in addition to heat being added to said circulating water by said first heat exchange coil of said primary closed loop refrigeration circuit and heat being extracted from said circulating water and added to said primary closed loop refrigeration circuit by said fourth heat exchange coil.

21. The air source heat pump system as claimed in claim 5, further comprising a seventh heat exchange coil constituting an auxiliary boiler and wherein said conduit means further comprises means for fluid connecting said seventh coil in parallel with said third coil and between said receiver and said expander and means for supplying heat to said auxiliary boiler such that regardless of operation of said third or fifth coils to supply thermal energy to said closed loop refrigeration circuit, said seventh coil may drive said expander and may additionally supply thermal energy directly to said first heat exchange coil.

22. The air source heat pump system as claimed in claim 17, wherein an electrical synchronous induction motor is coupled to said compressor for driving the same and wherein selectively operated clutch means mechancially couples said expander to said induction motor and said compressor, such that when said compressor is under loaded, said expander drives said compressor drive motor in excess of its synchronous speed to cause said motor to operate as an electrical generator and to transform available thermal energy into electrical form.

23. The air source heat pump system as claimed in claim 17, further comprising piping means defining a closed water circulation loop, means for alternately, thermally connecting said first and fourth heat exchange coils to said piping means forming said closed water circulation loop, and a plurality of individual, selectively operable cascade zone heat pumps connected in series within said piping means forming said closed water circulation loop; whereby, said cascade heat pumps may selectively add and subtract heat to the water circulating within said piping means in addition to heat being added to said circulating water by said first heat exchange coil of said primary closed loop refrigeration circuit and heat being extracted from said circulating water and added to said primary closed loop refrigeration circuit by said fourth heat exchange coil.

24. The air source heat pump system as claimed in claim 17, wherein said seventh coil comprises an auxiliary combustion boiler for direct flame impingement, and wherein said conduit means connecting said seventh coil to said expander comprises an auxiliary combustion boiler feed line leading from said receiver through said boiler to said expander feed line upstream of said expander feed port and said auxiliary combustion boiler feed line comprises a check valve for preventing refrigerant flow from said expander feed line towards said auxiliary combustion boiler and a control valve for selectively permitting flow of liquid refrigerant from said receiver to said auxiliary combustion boiler.

25. The air source heat pump system as claimed in claim 19, wherein said conduit means further comprise an air cooled condenser feed line leading from the other side of said fifth heat exchange coil to said receiver and an alternate feed line leading from said air cooled condenser feed line intermediate of said fifth heat exchange coil and said receiver to the inlet of said third heat exchange coil and pump means within said air cooled condenser feed line for pumping liquid refrigerant from said fifth heat exchange coil when operating as an air cooled condenser to said receiver and pump means within said alternate feed line for pumping refrigerant to said third heat exchange coil.

26. The air source heat pump system as claimed in claim 1, further comprising piping means defining a closed water circulation loop, means for alternately, thermally connecting said first and fourth heat exchange coils to said piping means forming said closed water circulation loop, and a plurality of individual, selectively operable cascade zone heat pumps connected in series within said piping means forming said closed water circulation loop; whereby, said cascade heat pumps may selectively add and subtract heat to the water circulating within said piping means in addition to heat being added to said circulating water by said first heat exchange coil of said primary closed loop refrigeration circuit and heat being extracted from said circulating water and added to said primary closed loop refrigeration circuit by said fourth heat exchange coil.

27. The air source heat pump system as claimed in claim 5, further comprising piping means defining a closed water circulation loop, means for alternately, thermally connecting said first and fourth heat exchange coils to said piping means forming said closed water circulation loop, and a plurality of individual, selectively operable cascade zone heat pumps connected in series within said piping means forming said closed water circulation loop; whereby, said cascade heat pumps may selectively add and subtract heat to the water circulating within said piping means in addition to heat being added to said circulating water by said first heat exchange coil of said primary closed loop refrigeration circuit and heat being extracted from said circulating water and added to said primary closed loop refrigeration circuit by said fourth heat exchange coil.

* * * * *

UNITED STATES PATENT AND TRADEMARK OFFICE

CERTIFICATE OF CORRECTION

PATENT NO. : 4,086,072

DATED : April 25, 1978

INVENTOR(S) : David N. Shaw

It is certified that error appears in the above-identified patent and that said Letters Patent are hereby corrected as shown below:

Column 14, line 40, change the number of the claim from [1] to --- 25 ---

Column 14, line 49, after "coil" change [connecting] to --- constituting ---

Column 15, line 12, change the number of the claim from [2] to --- 26 ---

Column 15, line 13, after "claim" change [1] to --- 25 ---

Column 15, line 23, change the number of the claim from [3] to --- 27 ---

Column 15, line 24, after "claim" change [2] to --- 26 ---

Column 15, line 34, change the number of the claim from [4] to --- 1 ---

Column 16, line 19, change the number of the claim from [5] to --- 2 ---

Column 16, line 29, change the number of the claim from [6] to --- 4 ---

Column 16, line 52, change the number of the claim from [7] to --- 8 ---

Column 17, line 1, change the number of the claim from [8] to --- 11 ---

Column 17, line 10, change the number of the claim from [9] to --- 6 ---

UNITED STATES PATENT AND TRADEMARK OFFICE

CERTIFICATE OF CORRECTION

PATENT NO. : 4,086,072

DATED : April 25, 1978

INVENTOR(S) : David N. Shaw

It is certified that error appears in the above-identified patent and that said Letters Patent are hereby corrected as shown below:

Column 17, line 27, change the number of the claim from [10] to --- 3 ---

Column 17, line 49, change the number of the claim from [11] to --- 7 ---

Column 17, line 66, change the number of the claim from [12] to --- 10 ---

Column 18, line 18, change the number of the claim from [14] to --- 15 ---

Column 18, line 32, change the number of the claim from [15] to --- 5 ---

Column 18, line 49, change the number of the claim from [16] to --- 9 ---

Column 18, line 58, change the number of the claim from [17] to --- 12 ---

Column 19, line 1, change the number of the claim from [18] to --- 14 ---

Column 19, line 15, change the number of the claim from [19] to --- 16 ---

Column 19, line 23, change the number of the claim from [20] to --- 23 ---

Claim 19, line 39, change the number of the claim from [21] to --- 17 ---

UNITED STATES PATENT AND TRADEMARK OFFICE

CERTIFICATE OF CORRECTION

PATENT NO. : 4,086,072

DATED : April 25, 1978

INVENTOR(S) : David N. Shaw

It is certified that error appears in the above-identified patent and that said Letters Patent are hereby corrected as shown below:

Column 19, line 51, change the number of the claim from [22] to — 18 —

Column 19, line 62, change the number of the claim from [23] to — 24 —

Column 20, line 10, change the number of the claim from [24] to — 19 —

Column 20, line 23, change the number of the claim from [25] to — 20 —

Column 20, line 36, change the number of the claim from [26] to — 21 —

Column 20, line 52, change the number of the claim from [27] to — 22 —

Signed and Sealed this

*Twenty-eighth* Day of *November 1978*

[SEAL]

*Attest:*

RUTH C. MASON
*Attesting Officer*

DONALD W. BANNER
*Commissioner of Patents and Trademarks*